US009383179B1

(12) United States Patent
Spilotro

(10) Patent No.: US 9,383,179 B1
(45) Date of Patent: Jul. 5, 2016

(54) FIREARM MAGAZINE STORAGE RACK WITH ADJUSTABLE PARTITIONS

(71) Applicant: Patrick Spilotro, Lincolnshire, IL (US)

(72) Inventor: Patrick Spilotro, Lincolnshire, IL (US)

( * ) Notice: Subject to any disclaimer, the term of this patent is extended or adjusted under 35 U.S.C. 154(b) by 0 days.

(21) Appl. No.: 14/706,367

(22) Filed: May 7, 2015

(51) Int. Cl.
*F42B 39/28* (2006.01)
*B65D 25/06* (2006.01)

(52) U.S. Cl.
CPC ..... *F42B 39/28* (2013.01); *B65D 25/06* (2013.01)

(58) Field of Classification Search
CPC ..... B65D 25/04; B65D 25/107; B65D 25/06; F42B 39/28; F42B 39/26
USPC ..... 211/26.2, 26.1, 70.3, 70.6, 70.7, 74; 206/565, 561, 557, 3, 327, 385, 384, 206/408, 201, 822
See application file for complete search history.

(56) References Cited

U.S. PATENT DOCUMENTS 42,943 A * 5/1864 Hance ..... A61B 19/0264 206/572
115,188 A * 5/1871 Frishmuth ..... B65D 25/04 217/7
129,545 A * 7/1872 Frazier ..... B65D 85/321 206/3
180,586 A * 8/1876 Hood ..... B65D 5/5266 206/744
454,772 A * 6/1891 Sagar ..... A47B 73/00 108/108
570,972 A * 11/1896 Wallis ..... A47F 3/00 211/74
720,119 A * 2/1903 Donnelly ..... B65D 5/5213 206/459.5
901,999 A * 10/1908 Perry ..... B65D 25/04 220/552
1,227,444 A * 5/1917 Jeckert ..... A24F 9/14 211/126.14
1,431,255 A * 10/1922 Rhodes ..... B65D 25/04 217/36
1,708,612 A * 4/1929 Gilbert ..... A47G 21/14 211/69
1,739,730 A * 12/1929 Orthwine ..... A47F 5/0062 206/459.5
1,873,557 A * 8/1932 Davis ..... A47F 3/14 206/561
2,207,017 A * 7/1940 Lemerman ..... B65D 85/305 206/201
2,615,581 A * 10/1952 Sigrist ..... B60N 3/12 211/70.3
3,220,558 A * 11/1965 Olsson ..... F25D 23/04 211/74
3,356,229 A * 12/1967 Rhymes, Jr. ..... A24F 9/14 211/70.3
3,517,822 A * 6/1970 Wagner ..... A47B 37/00 211/11
3,811,745 A * 5/1974 Cylke ..... G11B 23/0236 206/387.15

(Continued)

*Primary Examiner* — Michael Safavi
(74) *Attorney, Agent, or Firm* — Robert A. Parsons; Michael W. Goltry; Parsons & Goltry

(57) ABSTRACT

A firearm magazine storage rack for holding firearm magazines is provided. The rack includes a frame having opposing spaced apart side elements, each side element having a top edge, a bottom edge, a front edge and a back edge, and at least one cross piece extending between and coupling the side elements in a parallel spaced apart orientation. A shelf element extends between the side elements intermediate the bottom edges and the top edges thereof. A partition support extends between the side elements intermediate the shelf element and the top edge of the side elements, and a plurality of partition elements are adjustably received by the partition support hanging vertically and extending perpendicularly outwardly therefrom.

7 Claims, 5 Drawing Sheets

(56) References Cited

U.S. PATENT DOCUMENTS 3,827,570 A * 8/1974 Betts ..... B42F 17/02 206/449
3,945,499 A * 3/1976 Brownson ..... A47G 29/08 211/70.6
4,022,517 A * 5/1977 Eckert ..... A47F 3/00 312/107
4,138,015 A * 2/1979 Rabley ..... A47B 87/0261 206/561
4,560,072 A * 12/1985 Burrell ..... A47F 5/00 211/126.1
4,602,715 A * 7/1986 Sarver ..... B65D 81/05 206/515
4,776,477 A * 10/1988 Walker ..... B65D 7/24 206/561
5,133,489 A * 7/1992 Loew ..... B60R 11/00 206/3
5,139,186 A * 8/1992 Loew ..... B60R 11/00 206/3
5,148,942 A * 9/1992 Snook ..... B65D 25/06 206/425
5,193,680 A * 3/1993 Schumann ..... B65H 16/021 206/394
5,553,724 A * 9/1996 Moher ..... A47F 7/0064 211/150
6,012,585 A * 1/2000 Parker ..... A47B 67/02 206/538
7,111,732 B1 * 9/2006 Houtler ..... A47G 33/08 206/499
7,500,635 B2 * 3/2009 Cooper, Jr. ..... B65H 35/00 206/408
7,568,582 B1 * 8/2009 Berger ..... A47B 49/00 108/101
2004/0079662 A1 * 4/2004 Wang ..... B25H 3/02 206/378
2004/0089620 A1 * 5/2004 Chen ..... B25H 3/04 211/70.6
2012/0042489 A1 * 2/2012 Cai ..... E04H 13/006 27/35

* cited by examiner

FIREARM MAGAZINE STORAGE RACK WITH ADJUSTABLE PARTITIONS

FIELD OF THE INVENTION

This invention relates to firearm magazines.

More particularly, the present invention relates to firearm magazine storage devices.

BACKGROUND OF THE INVENTION

In the use of firearms, an area of concern is the storage of magazines. Many firearms, semi-automatic and automatic in particular, utilize magazines for supplying rounds to the chamber of the firearm. When the magazine is exhausted, it is removed from the firearm, and replaced with a charged magazine. Often, individuals will carry multiple magazines on their persons, typically in pockets or pouches affixed to a belt and the like. However, the ammunition must be moved from "loose" rounds, as supplied in ammunition boxes, to ammunition carried by a magazine. When not in use, the magazine must be stored.

For most civilian individuals, magazines can be charged when desired, and carried on their person. However, between times, the magazines must be stored, charged or uncharged. Often, magazine are simply deposited in a box, in a drawer or simply laid on a shelf. While somewhat effective, this method of storage can cause clutter, difficulty locating a magazine of specific caliber or style, and is just inefficient. Magazines simply piled in a drawer, a box or on a shelf often need to be sorted through to locate the desired individual magazine when multiple magazines are present. Additionally, handling of a magazine in this manner can cause damage.

For military or law enforcement use, the availability of a charged magazine is often critical. Additionally, the organization supporting these individuals is often required to control and account for all ammunition expenditures. Thus, the organization often does not dispense the magazines until just prior to deployment. Additionally, individuals may need more available magazines then they can carry, such as during a heavy firefight or long operation. In these instances, there is a need for large storage capacity of charged magazines. This is traditionally accomplished by storing them in boxes and the like in vehicles or an arms locker. The downside to storage boxes is that the magazines are difficult to access, have the potential to be damaged, and it is difficult to account for and easily determine how many magazines have been dispensed. In civilian use, magazines are typically stored in boxes, pouches, or simply left lying around.

It would be highly advantageous, therefore, to remedy the foregoing and other deficiencies inherent in the prior art.

An object of the present invention is to provide a device for storing charged/uncharged magazines.

Another object of the present invention is to provide a device for storing magazines that protects the magazines and allows quick and easy access.

Yet another object of the present invention is to provide a device for storing magazines that can be employed in vehicles, arms lockers, rooms, etc.

A further object of the present invention is to provide a firearm magazine storage rack which is adjustable by the consumer to secure a variety of magazines of different heights and widths.

SUMMARY OF THE INVENTION

Briefly, to achieve the desired objects and advantages of the instant invention, provided is a firearm magazine storage rack including a frame having opposing spaced apart side elements, each side element having a top edge, a bottom edge, a front edge and a back edge, and at least one cross piece extending between and coupling the side elements in a parallel spaced apart orientation. A shelf element extends between the side elements intermediate the bottom edges and the top edges thereof. A partition support extends between the side elements intermediate the shelf element and the top edge of the side elements, and at least one partition element is adjustably received by the partition support hanging vertically and extending perpendicularly outwardly therefrom.

The partition support includes a front surface and an opposing back surface, the back surface having a plurality of stops separated by gaps. The at least one partition element includes opposing surfaces defined by a front edge, a back edge, a top edge, a bottom edge, and a slot formed in and extending from the bottom edge and terminating at a position spaced apart from the top edge.

In a specific aspect, the slot has a width greater than a thickness of the partition support between the front surface thereof and the gap between stops on the back surface thereof, and a width less than a thickness of the partition support between the front surface thereof and the stops on the back surface thereof. The stops include ridges extend from a top edge of the partition support to a bottom edge of the partition support, and wherein the slot of the at least one partition element is receivable over the top edge of the partition support in the gap between the ridges, the ridges contacting and stabilizing the at least one partition along the entire length of the ridges.

The at least one partition element extends generally perpendicularly from the partition support, with the front edge of the at least one partition element extending perpendicularly forwardly therefrom and the back edge of the at least one partition element extending perpendicularly rearwardly therefrom, with the back edge of the at least one partition element terminating at or before reaching a plane defined by the back edges of the side elements.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
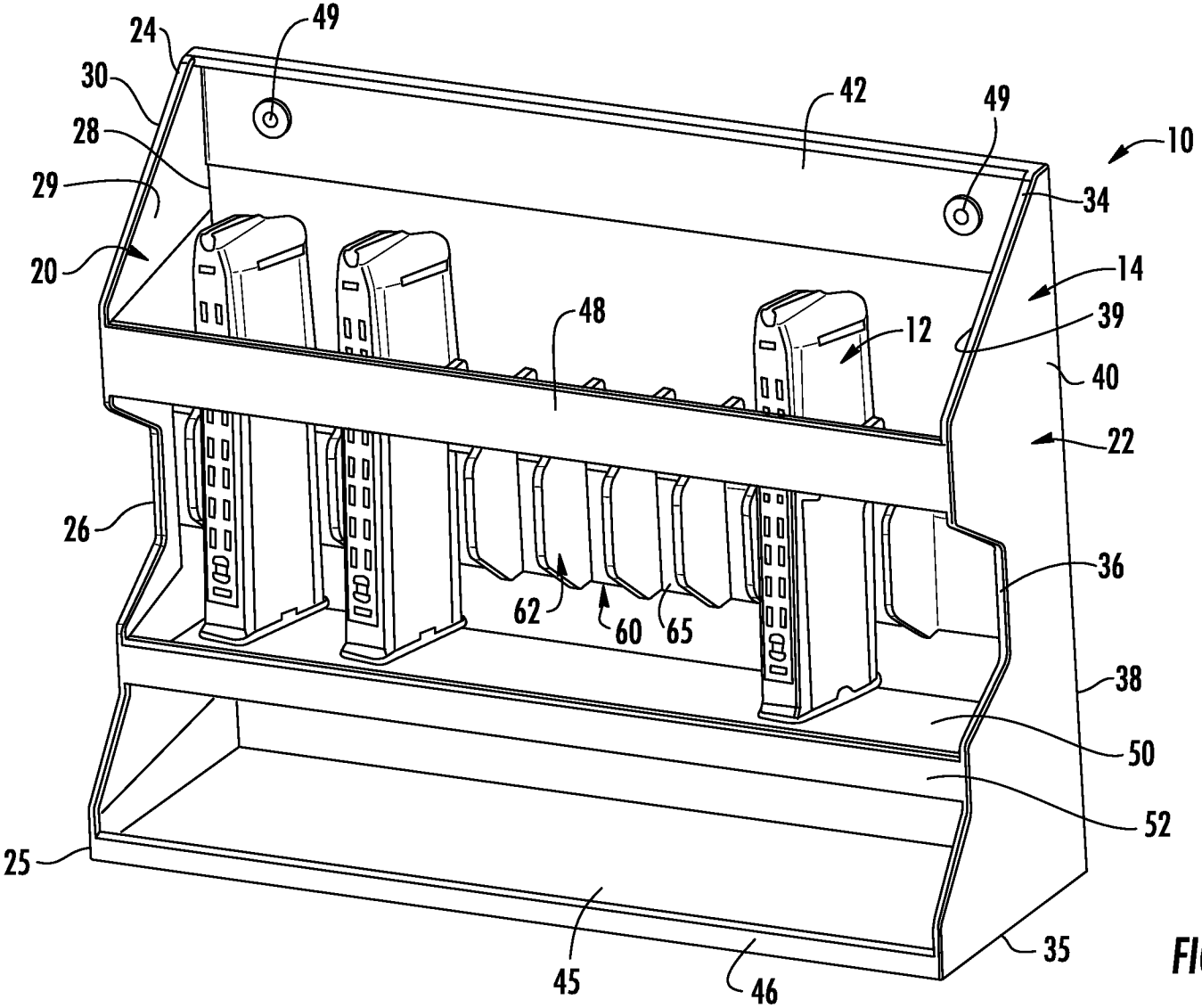
FIG. 1 is a front perspective view of a firearm magazine storage rack according to the present invention.
Figure 2:
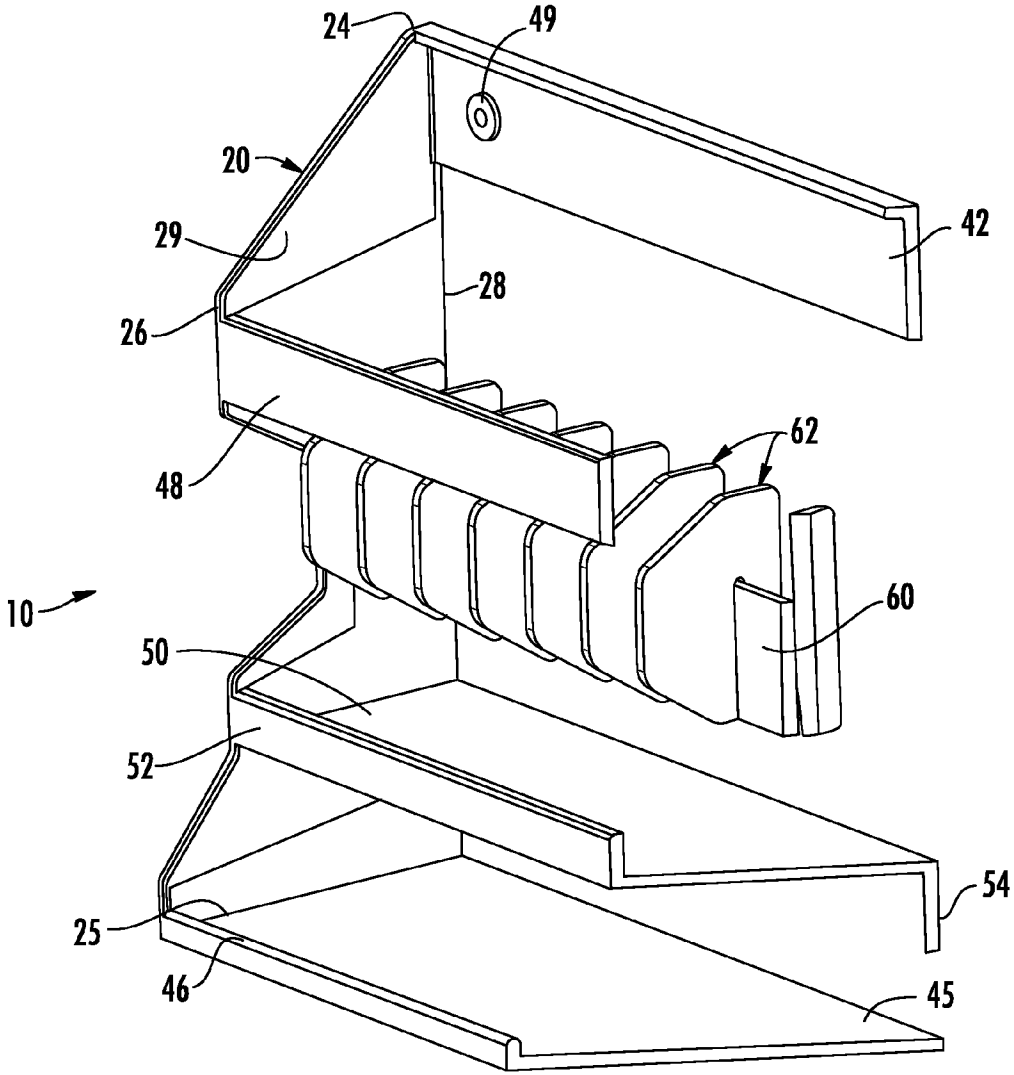
FIG. 2 is a sectional side view of FIG. 1, taken along line 2-2.

Turning now to the drawings in which like reference characters indicate corresponding elements throughout the several views, attention is directed to FIGS. 1 and 2 which illustrates a firearm magazine storage rack with adjustable partitions, generally designated 10. Rack 10 is intended to be mounted to an upright surface for storing firearm magazines 12 having generally flat bottoms and straight sides. The upright surface can be in a building, vehicle, storage unit, gun safe and the like. Rack 10 can store magazines of different sizes and widths, as well as charged (filled) or uncharged.

Rack 10 includes a frame 14 having opposing spaced apart side elements 20 and 22. Side element 20 has a top edge 24, a bottom edge 25, a front edge 26, a back edge 28 and inner and outer surfaces 29 and 30. Side element 22 has a top edge 34, a bottom edge 35, a front edge 36, a back edge 38 and inner and outer surfaces 39 and 40. An upper cross piece 42 extends between side elements 20 and 22 proximate top edges 24 and 34 at back edges 28 and 38. A bottom element 45 extends between side elements 20 and 22 at bottom edges 25 and 35, and preferably extends from back edges 28 and 38, to front edges 26 and 36. A lip 46 extends upwardly from the front of bottom element 45. A front cross piece 48 extends between side elements 20 and 22 spaced apart from top edges 24 and 34 at front edges 26 and 36, so as to be positioned intermediate bottom element 45 and upper cross piece 42. Upper cross piece 42, bottom element 45 and front cross piece 48 extend between and couple side elements 20 and 22 in a parallel spaced apart orientation. Frame 14 provides a rigid structure which can be mounted by mounting elements (apertures 49 for receiving fasteners such as screws and the like) to an upright surface to support magazine receiving elements for securely holding magazines.

Figure 3:
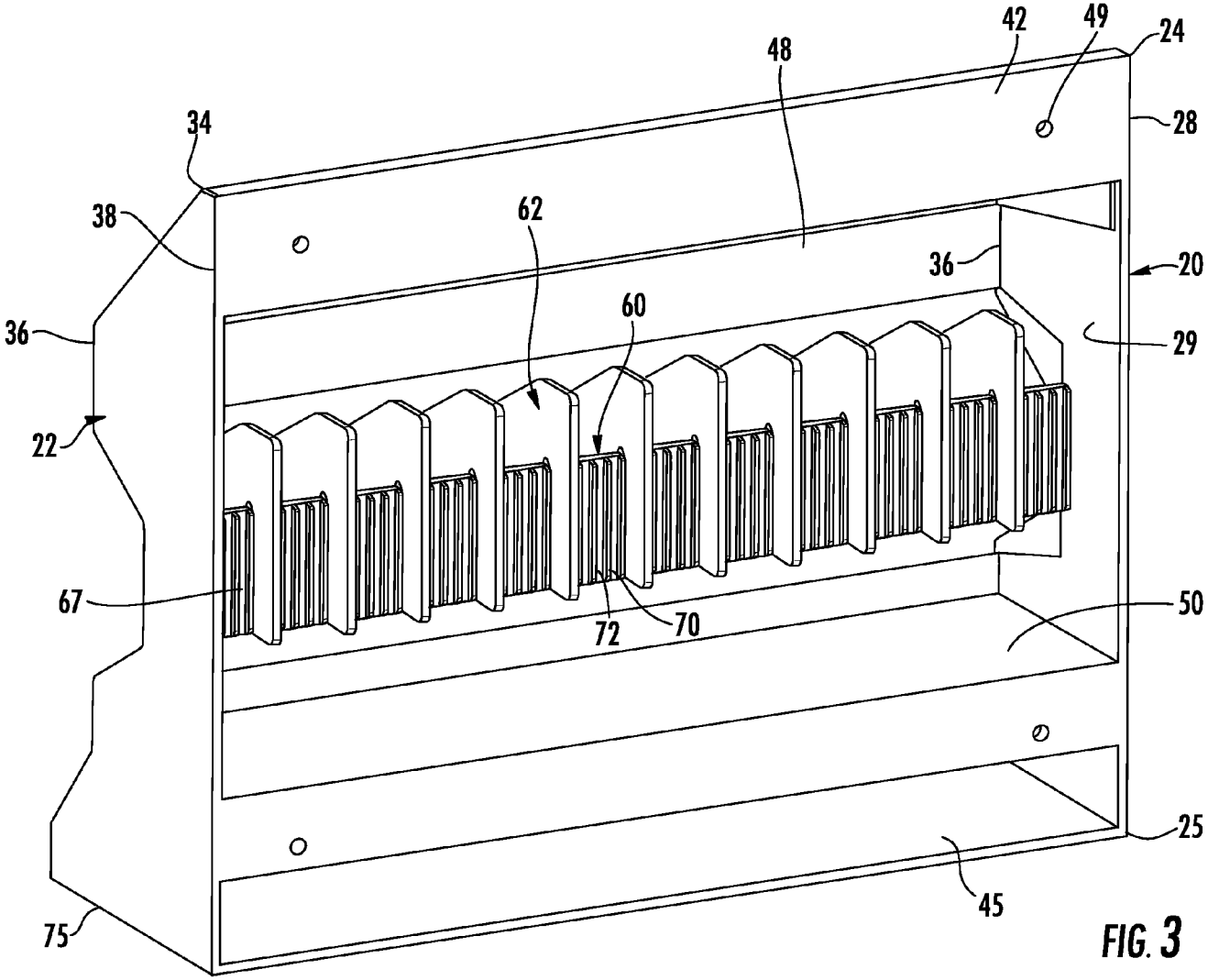
FIG. 3 is a back perspective view of the firearm magazine storage rack of FIG. 1.
Figure 4:
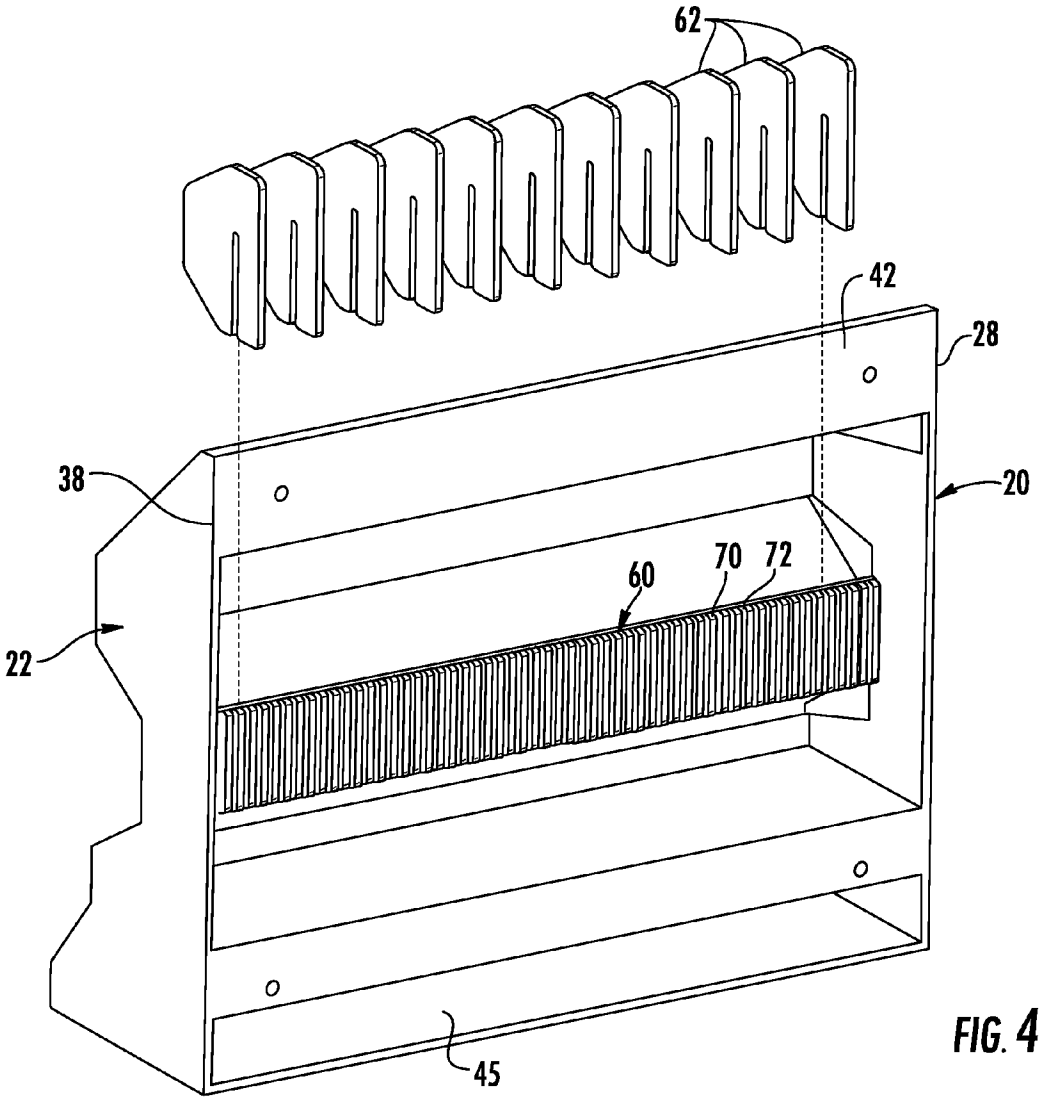
FIG. 4 is a back perspective view of the firearm magazine storage rack of FIG. 3 with the plurality of partition elements removed.

With additional reference to FIGS. 3 and 4, the magazine receiving elements include a shelf element 50 extending between side elements 20 and 22 intermediate bottom element 45 and front cross piece 48. Shelf element 50 preferably extends from back edges 28 and 38, to front edges 26 and 36. A lip 52 extends upwardly from the front of shelf element 50 and a lip 54 extends downwardly from the rear of shelf element 50. Shelf element 50 includes a generally planar top surface for receipt of the bottoms of magazines 12 thereon. A partition support 60 extends between side elements 20 and 22 intermediate shelf element 50 and upper cross piece 42. Partition support 60 extends from side elements 20 and 22 spaced from back edges 28 and 38 sufficient to accommodate partition elements 62 thereon, as will be described presently, without those partition elements extending rearwardly beyond a plane defined by back edges 28 and 38. This permits frame 14 to lie flat against an upright surface to which frame 14 is mounted. Partition support 60 includes a top edge 63, a bottom edge 64, a front surface 65 and a back surface 67. Front surface 65 is generally planar for receipt of the sides of magazines 12 thereagainst, while back surface 67 includes a plurality of stops separated by gaps. In this preferred embodiment, the stops are vertically extending and horizontally spaced apart ridges 70 separated by gaps 72.

Figure 5:
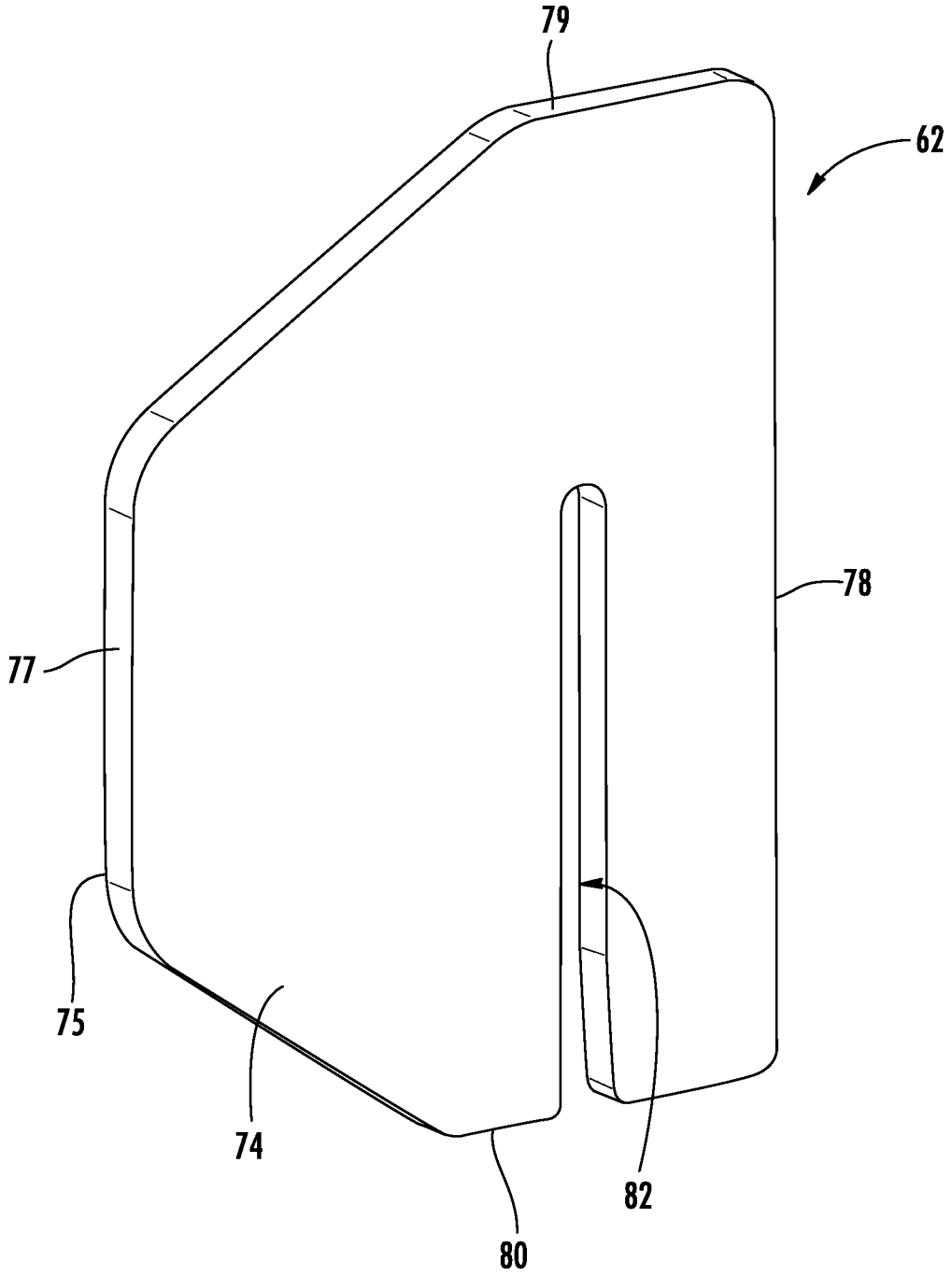
FIG. 5 is a perspective view of a partition element.

With reference to FIG. 5, partition elements 62 each include opposing, generally planar surfaces 74 and 75, defined by a front edge 77, a back edge 78, a top edge 79 and a bottom edge 80. A slot 82 is formed in each of partition elements 62, extending from bottom edge 80 and terminating at a position spaced apart from top edge 79. Slot 82 has a width sufficient to slide over top edge 63 of partition support 60 at gaps 72 between ridges 70. Thus, the width (from front to back) of slot 82 is larger than a thickness of partition support 60 between front surface 65 and back surface 67 at gaps 72 between ridges 70, and has a width less than a thickness of partition support 60 between front surface 65 thereof and ridges 70 on back surface 67. Ridges 70 contact partition elements 62 along substantially the entire length of slot 82, preventing lateral motion along partition support 60. Partition elements 62 hang vertically from partition support 60 and extend generally perpendicularly from partition support 60, with front edge 77 extending perpendicularly forwardly therefrom and back edge 78 extending perpendicularly rearwardly therefrom. It will be understood that back edge 78 does not extend beyond the plane defined by back edges 28 and 38 of side elements 20 and 22. This enables frame 14 to lie generally flush against an upright surface. A partition element 62 can be adjusted by removing it from partition support 60 and relocating it between any of ridges 70 at gaps 72. In this manner, the distance between adjacent partition elements can be adjusted to form a magazine receiving space of adjustable size to accommodate magazines of different sizes.

Frame 14 and the magazine receiving elements, accept partition elements 62, are preferable formed of a one piece construction such as by molding in plastic. While molded plastic is preferred, it will be understood that frame 14 and the various other elements can be constructed of wood, metal, ceramic, and the like, and function properly.

Referring back to FIG. 1, magazines 12 can be positioned between properly adjusted partition elements 62 and supported by shelf element 50. Wider magazines 12 may require greater spacing of partition elements 62, while narrower magazines require less spacing. When properly positioned, lateral movement of magazines 12, from side to side, is prevented by partition elements 62, while magazines are supported vertically by shelf element 50. Forward and backward movement of magazines 12 is controlled by front cross piece 48 and lip 52.

Thus disclosed is a firearm magazine storage rack 10 capable of storing a plurality of magazines in a secure and upright manner and adjustable for magazines of variable width. This permits the magazines to not only be stored in stationary locations such as building, ammunition lockers, gun safes, and the like, but also to be carried by vehicles over rough terrain while maintaining ease of access and the ability to keep track of and count individual magazines quickly and easily.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A firearm magazine storage rack and magazine, comprising:

a magazine having a flat bottom and straight sides;

a frame having opposing spaced apart side elements, each side element having a top edge, a bottom edge, a front edge and a back edge, and at least one cross piece extending between and coupling the side elements in a parallel spaced apart orientation;

a shelf element extending between the side elements intermediate the bottom edges and the top edges thereof, the flat bottom of the magazine resting thereon;

a partition support extending between the side elements above the shelf element, the partition support includes a front surface and an opposing back surface, the back surface having a plurality of stops separated by gaps;

a plurality of partition elements received by the partition support and defining a plurality of magazine spaces therebetween, each of the plurality of partition elements hanging vertically and extending perpendicularly from the partition support, the magazine received in one of the plurality of magazine spaces; and each of the plurality of partition elements include opposing surfaces defined by a front edge, a back edge, a top edge, a bottom edge, and a slot formed in and extending from the bottom edge and terminating at a position spaced apart from the top edge.

2. A firearm magazine storage rack and magazine as claimed in claim 1 wherein the slot of each of the plurality of partition elements has a width greater than a thickness of the partition support between the front surface thereof and the gaps on the back surface thereof, and a width less than a thickness of the partition support between the front surface thereof and the stops on the back surface thereof.

3. A firearm magazine storage rack and magazine as claimed in claim 2 wherein the stops include ridges extending from a top edge of the partition support to a bottom edge of the partition support, and wherein the slot of each of the plurality of partition elements is receivable over the top edge of the partition support in the gaps, the ridges contacting and stabilizing the plurality of partitions along the entire length of the ridges.

4. A firearm magazine storage rack and magazine as claimed in claim 1 wherein each of the plurality of partition elements extends generally perpendicularly from the partition support, with the front edge of each of the plurality of partition elements extending perpendicularly forwardly therefrom and the back edge of each of the plurality of partition elements extending perpendicularly rearwardly therefrom, with the back edge of each of the plurality of partition elements terminating at or before reaching a plane defined by the back edges of the side elements.

5. A firearm magazine storage rack and magazine as claimed in claim 1 wherein the at least one cross piece includes an upper cross piece extending between the side elements proximate the top edges at the back edges thereof.

6. A firearm magazine storage rack and magazine as claimed in claim 5 wherein the at least one cross piece further includes a bottom element extending between the side elements at the bottom edges thereof, and extending from the back edges to the front edges.

7. A firearm magazine storage rack and magazine as claimed in claim 6 wherein the at least one cross piece further includes a front cross piece extending between the side elements, spaced apart from the top edges at the front edges thereof, so as to be positioned intermediate the bottom element and the upper cross piece.

* * * * *